US006859948B2

(12) United States Patent
Melts

(10) Patent No.: US 6,859,948 B2
(45) Date of Patent: Mar. 1, 2005

(54) HIP PROTECTOR SYSTEM

(75) Inventor: Michael Melts, 95 Spring La., Suffield, CT (US) 06078

(73) Assignee: Michael Melts, West Hartford, CT (US)

( * ) Notice: Subject to any disclaimer, the term of this patent is extended or adjusted under 35 U.S.C. 154(b) by 284 days.

(21) Appl. No.: 10/244,487

(22) Filed: Sep. 16, 2002

(65) Prior Publication Data

US 2004/0049827 A1 Mar. 18, 2004

(51) Int. Cl.[7] ..... A41D 27/26
(52) U.S. Cl. ..... 2/465; 2/23; 2/267
(58) Field of Search ..... 2/267, 455, 465, 2/23, 228, 238, 401, 466; 128/846, 891; 602/61

(56) References Cited

U.S. PATENT DOCUMENTS

| | | | | |
|---|---|---|---|---|
| 4,089,065 A | | 5/1978 | McGee | |
| 4,573,216 A | | 3/1986 | Wortberg | |
| 4,641,641 A | | 2/1987 | Strock | |
| 4,700,403 A | * | 10/1987 | Vacanti | 2/462 |
| 4,737,994 A | | 4/1988 | Galton | |
| 4,807,301 A | | 2/1989 | Ferber | |
| 4,926,883 A | | 5/1990 | Strock | |
| 4,977,623 A | | 12/1990 | DeMarco | |
| 5,036,548 A | | 8/1991 | Grilliot et al. | |
| 5,062,433 A | | 11/1991 | Kummer | |
| 5,497,511 A | | 3/1996 | Zade | |
| 5,500,952 A | | 3/1996 | Keyes | |
| 5,551,091 A | * | 9/1996 | Tyndall | 2/227 |
| 5,557,804 A | | 9/1996 | Ovortrup et al. | |
| 5,584,072 A | * | 12/1996 | Kim et al. | 2/465 |
| 5,599,290 A | * | 2/1997 | Hayes et al. | 602/61 |
| 5,636,377 A | * | 6/1997 | Wiener | 2/465 |
| 5,675,844 A | * | 10/1997 | Guyton et al. | 2/455 |
| 5,717,997 A | | 2/1998 | Garcia | |
| 5,722,093 A | | 3/1998 | Andresen | |
| 5,790,981 A | | 8/1998 | Bzoch | |
| 5,836,015 A | | 11/1998 | Kristensen et al. | |
| 5,867,842 A | | 2/1999 | Pinsley et al. | |
| 5,918,310 A | * | 7/1999 | Farahany | 2/23 |
| 6,093,468 A | * | 7/2000 | Toms et al. | 428/67 |
| 6,195,809 B1 | * | 3/2001 | Garcia | 2/455 |
| 6,282,724 B1 | | 9/2001 | Abraham et al. | |
| 6,334,443 B1 | | 1/2002 | Olsen | |
| 6,345,396 B1 | * | 2/2002 | Schuler | 2/467 |
| 6,453,477 B1 | * | 9/2002 | Bainbridge et al. | 2/455 |
| 6,709,729 B2 | * | 3/2004 | Baruch | 428/101 |

OTHER PUBLICATIONS

Collection of "HIP Saver" and related materials of Hip Saver, Inc. (13 pages).
"SAFEHIP" Brochure (2 pages).
"Save Hip" Article (2 pages).

(List continued on next page.)

*Primary Examiner*—Rodney M. Lindsey

(57) ABSTRACT

Hip protector (10) worn primarily by the elderly, preventing/reducing hip fractures, resulting from a fall. The protector is made of all-soft materials using a matching pair of hip protective holsters (14/24) interconnected by a waist encircling belt (16) from which a pair of protective pad pouches (20) are suspended in the holsters over the user's hips and secured in place by leg encircling bands (18/26). The protective pouches include foam bodies (54) with underlying, intermediate, spacer elements (42) and a bottom cover (50), all in combination creating an enclosed, moisture-holding, air chamber (80). The protector is worn under clothing (under pants, bed clothes or swimming trunks, etc.), light weight, easily put on & removed, does not interfere in daily living (sleeping, usual body movements, restroom or bathing activities, etc.), and, when the user sweats, the surface of the user's skin under the hip protector is maintained dry using "one-way-moisture flow" material.

17 Claims, 4 Drawing Sheets

OTHER PUBLICATIONS

"SAFEHIP" Flyer (2 pages; www.tytex.com/news.article_136.html).
"SafeHip" Related Web Page (1 page; www.asaging.org/at–219/Designs.html).
"Hip Protection" Web Page (1 page; www.tytex.com/our_products/hip_protection/).
"SAFEHIP+ Range of Hip Protectors" (2 pages; www.tytex.com/our_products/hip_protection/our_range.html).
"HIProtector"Flyer (4 pages).
"injuryboard.com"—"injures" (2 pages; www.injuryboard.com/specificArticleFromSiteSearch.cfm?Article=693).
"Hip Pads: Effective Fracture Prevention" (2 pages; Russian article).
"Hip Protectors" AgeNet Workship Report (4 pages; Oct. 22, 1999, London).
"Posey Hipsters" Flyer (1 page).
"Fall Prevention and Protection" (1 page; www.posey.com/products/6016.html).
Product Photograph on Web (1 page; store5.yimg.com/I/hips_1686_87729).
"Geriatric Protection Products" Web Page (1 page; www.preventproducts.com/geri/gerihip.html).

* cited by examiner

SKIN

HIP PROTECTOR SYSTEM

TECHNICAL FIELD

The present invention relates to hip protectors designed to protect the hips of the user/patient in a fall, that is, to reduce, if not avoid, damage to the hip(s) which would otherwise result from, for example, a fall, and more particularly to those hip protectors preferably used under clothing.

BACKGROUND ART

Hip fractures are a major health and economic problem for the elderly and our society as a whole. Greater trochanter protrudes outwardly from the proximal femur just below the joint and the adjoining thin neck of the femur. This region is relatively poorly protected by muscle and other body tissue in comparison with the regions of the hip surrounding it. In fact, the greater trochanter is readily accessible to the touch, its position being generally indicated by an elevation in the hip area due to the thinness of the tissues that cover it. Most hip fractures occur as a result of a fall from a standing (or other normal for daily activities) position. Measurements of the falling force needed to hip fracture the elderly have shown the fracture threshold to be 2,110 Newtons (see J. C. Lots and W. C. Hayes, *The Journal of Bone and Joint Surgery*, vol. 72-A, No. 5, June 1990, pp 689–700). Many experts predict a future epidemic of hip fractures because population of our planet is aging.

For example, according to the American Academy of Orthopaedic Surgeons, in the USA there were more than 238,000 hospitalizations for hip fractures in 1990 and more than 323,000 in 1996. The number of hip fractures could reach 512,000 by 2040 and 650,000 by 2050 (could reach more than 6,000,000 in the world by 2050). Nearly 33% of women and more than 17% of men will experience a hip fracture if they live to age 90. Furthermore, disorders such as Parkinson's Disease, Alzheimer's Disease, and stroke are associated with high annual incidence of hip fracture. Among patients who are functionally independent prior to a hip fracture, 15% to 25% remain in long-term care settings for more than a year afterward. Another 25% to 35% are dependent on others for their mobility. More than half of those that survive hip fracture never recover normal function. The death rate for hip fracture patients is higher than for other people of the same age who do not sustain the injury. As many as 20% of all people who suffer a hip fracture die within a year, usually because of complications like pneumonia or blood clots in the lung that are related to either the fracture itself, surgery to heal the break, or being confined to bed. According to the American Academy of Orthopedic Surgeons, in 1998 the cost to the U.S. health care system for acute and convalescent care for patients with hip fractures was more than $12.6 billion. That's an average of $37,000 per patient.

The prior art of hip protectors has two classes—hip protectors for using over clothing and hip protectors for using under clothing.

Hip protectors for use over clothing typically have soft or hard protective devices with permanent cubic capacity. These protectors do not combine protection, comfort and ease of use and look very unaesthetic over clothing. In the development of these protectors it was most logical to look towards the airbag, also known as the "Safety Air Cushion" (SAC). This practical device was invented and designed to protect drivers and passengers in automobile accidents. Examples of airbags and airbag inflation devices are found in U.S. Pat. No. 3,430,979, which uses pressurized gas for inflation; U.S. Pat. Nos. 4,178,016 and 4,243,248, which both use pyrotechnic devices for inflation. The solution is to provide each elderly citizen with an inflatable bag. Such a bag would be equipped with a motion detector which would sense that a fall is in progress. Upon detecting a fall, the sensor would activate a pressure source to rapidly expand the bag and thereby cushion the individual from the impact of the fall. Examples of this approach are U.S. Pat. Nos. 4,089,065; 5,500,952 & 5,867,842, which use sensor, power source, control unit, compressed gas cartridge(s) with releaser(s) and air bag(s). Such protector approach is much too complicated, needs very reliable electronic and electromechanical units, changes of compressed gas cartridge(s) after fall, and can be much too expensive to many elderly individuals.

The prior art for hip protectors for using under clothing does not achieve combined protection, comfort and ease of use too. Girdle-like undergarments of the prior art, whether using essentially pads or inflatable bags, are difficult to put on and take off, and can create other significant problems for elderly people. For example, some must be removed e. g. when bathing or going to the toilet, but a lot of hip fractures, around 20%, comes from falling on the often hard and slippery floors during bathing and going to the toilet. Examples of such devices are U.S. Pat. Nos. 4,737,994; 4,977,623 & 5,297,293. If such garments are not completely moisture resistant, they will soon become dirty and probably soiled with urine and feces. The result is unsanitary, unpleasant, unsightly and uncomfortable for both patients and attendants. Additionally, such garments, which by their very nature must fit snugly, can compromise blood circulation and could contribute to the development of decubitus ulcers, a dangerous problem with significant morbidity and even mortality in elderly, immobile and bedridden patients.

U.S. Pat. No 5,584,072, which discloses a hip protector using a belt with a hard buckle lock, a pair of holsters with hard shells and leg straps. This device can not be easily put on, adjusted to fit comfortably and removed by a person who is elderly, infirm or whose fingers, hands and grip have been weakened by arthritis and/or other neuromuscular conditions. Additionally, this hip protector is not very comfortable to a wearer because it has hard shells/shields (the same may be said of the devices of U.S. Pat. Nos. 4,641,641; 4,926,883; 5,062,433; 5,497,511; 5,636,377; 5,722,093 & 6,334,443). The results of using hard shells include different problems, for example, the discomfort during sleeping, sitting or other daily activities, and problems for washing/drying, etc. If wearer can take out hard shells from pockets before, for example, sleeping, can arise other problems: during sleeping wearer can fall from bed or after sleeping old wearer can forget put in pockets these shells—in both cases the wearer does not have a defense from hip fractures.

U.S. Pat. No. 4,807,301, which discloses a protective garment for the hip area and uses a size-adjustable, wrap-around form, is adapted to fit under buttocks and includes pockets with shock-absorbent pads of PVC nitrile foam. This garment can change its position on the user's body during sleeping or other daily activities and must be removed e. g. when bathing or going to the toilet if the user needs to defecate. U.S. Pat. No. 5,918,310, which discloses a body protective garment uses a soft, multi-layer polyurethane foam composite for hip protection. This garment must be removed e. g. when bathing or going to the toilet, and, due to the using of flaps, buttons and zippers, this device can not be easily put on, adjusted to fit comfortably and removed by a person who is elderly, infirm or whose fingers, hands and grip have been weakened by arthritis and/or other neuromuscular conditions.

In the USA some companies, for example, "HIProtector" (Wellesley, Mass.; marketed at www.hiprotector.com), "SafeHip" (Tytex, Inc.,Woonsocket, R.I.; www.tytex.com, previously marketed at www.savehip.com, now possibly no longer marketed), HipSaver (Canton, Mass.; marketed at www.hipsaver.com), and J. T. Posey Company (Arcadia, Calif.; marketed at www.posey.com), make or have made different hip protectors.

An analysis of all of these products and the other prior art hip protectors for using under clothing shows that each of these hip protectors (HP) usually has good shock absorbing characteristics, but at the same time has some very serious shortcomings as listed in the following table.

| PROBLEM CATEGORY | SHORTCOMING | CAUSE of SHORTCOMING |
|---|---|---|
| I. Poor Protection | 1. HP must be removed when going to the toilet if user needs to urinate. | Construction of Hip Protection ("HP") |
| | 2. HP must be removed when going to the toilet if user needs to defecate. | Construction of HP |
| | 3. HP must be removed when bathing if user needs to apply soap and wash the skin under the HP. | Construction of HP, fabric (cotton or comparable) is not intended for repeated and great stretching with following return to the point of departure. |
| | 4. Undesired displacement of protective parts of the HP relative to the user's hip. | Construction of HP, fabric (cotton or comparable) is intended for repeated and great stretching with following return to the point of departure; very poor range of HP sizes. |
| II. Physiological or Other Discomfort | 5. After swimming or bathing the user's skin is in contact with moist fabric of the HP for long periods of time. | Fabric (cotton or comparable) of HP typically takes a long time to dry. |
| | 6. User's sweaty skin comes into contact with moist fabric of HP for extended periods of time. | Fabric (cotton or comparable) of HP absorbs moisture but cannot transport moisture away. |
| | 7. User's skin under protective pad of HP can not "breathe." | Construction of HP |
| | 8. Discomfort from hard shells of HP during sleeping or sitting. | Construction of HP |
| | 9. Discomfort from using multiple straps, wraps, buttons and/or zippers. | Construction of HP |
| | 10. HP is too large, heavy & cumbersome and unaesthetic. | Construction of HP |

For example, the protector device marketed at www.hipsavers.com includes a specially constructed boxer-style underwear having compressible pads integrally associated with the underwear and positioned so as to ride over the hip joints. The "SlimFit" model of this hip protector has some very serious shortcomings, including from the foregoing list, for example #1, #2, #5, #6 and #7. The hip protector's "HipSaver Nursing Home" model also has the same shortcomings. The hip protector, which is marketed at www.safehip.com and which apparently received a first-place "Silver Award" at the 13th Annual Society on Aging (ASA) Products for Aging Society Design Competition 2001, is made of two, rigid, plastic, concave pieces which are placed in pockets in specially constructed boxer-style underwear such that the plastic pieces ride over and cup the hip joints. This hip protector likewise has some very serious shortcomings from the foregoing list, for example, #1, #2, #5, #6, #7 and #8.

Hip protectors for using under clothing from the prior art, including those on the market noted above, require different models for males and for females. This mean that a company for one model of hip protector with "N" different hip protector sizes has to make and inventory two times (2×N) the number of hip protector versions. Thus, for "K" models ths will require "2×N×K" different versions, causing substantial increases in manufacturing costs & inventory costs. Unfortunately some companies prefers for easier inventory control to make for one model a small number of different hip protector's sizes, for example, only small, medium and large sizes. The result of this can be the incorrect positioning of the protective device on the user's body.

Thus, some patents which may be of general background interest, are:

| Patent No. | Issue Date | Patentee(s) |
|---|---|---|
| 4,089,065 | May 1978 | McGee |
| 4,641,641 | February 1987 | Strock |
| 4,737,994 | April 1988 | Galton |
| 4,807,301 | February 1989 | Ferber et al. |
| 4,926,883 | May 1990 | Strock |
| 4,977,623 | December 1990 | DeMarco |
| 5,062,433 | November 1991 | Kummer |
| 5,497,511 | March 1996 | Zade |
| 5,500,952 | March 1996 | Keyes |
| 5,584,072 | December 1996 | Kim et al. |
| 5,636,377 | June 1997 | Wiener |
| 5,722,093 | March 1998 | Andresen |
| 5,867,842 | February 1999 | Pinsley et al. |
| 5,918,310 | July 1999 | Farahany |
| 6,334,443 | January 2002 | Olsen |

Some additional patents of which the inventor is aware include:

| Patent No. | Issue Date | Patentee(s) |
|---|---|---|
| 4,573,216 | March 1986 | Wortberg |
| 5,036,548 | August 1991 | Grilliot et al |
| 5,557,804 | September 1996 | Ovortrup et al. |
| 5,717,997 | February 1998 | Garcia. |
| 5,790,981 | August 1998 | Bzoch |
| 5,836,015 | November 1998 | Kristensen et al. |
| 6,093,468 | July 2000 | Toms et al. |
| 6,282,724 | September 2001 | Abraham et al. |

Also, some publications, copies of which are included with the filing of the present application, along with others, which may be of general background interest, are:

*The Use of Quantitative Computer Tomography to Estimate Risk of Fracture of the Hip From Falls*, by Jeffrey C. Lots and Wilson C. Hayes, *The Journal of Bone and Joint Surgery*, vol. 72-A, No. 5, June 1990;

*Prediction of Femoral Impact Forces in Falls on the Hip*, S. N. Robinovitch, W. C. Hayes, *Journal of Biomedical Engineering*, vol.113, November 1991; and

*Energy Shunting Hip Padding System Femoral Impact Force From a Simulated Fall to Below Fracture Threshold*, W. C. Hayes, S. N. Robinovitch, T. A. McMahon, *Proc. of Third Injury Prevention Through Biomechanics* CDC Symp. 1993;

as well as some internet sites, from which copies of selected pages are included with the filing of the present application, which may be of general background interest include:

www.hiprotector.com;

www.hipsaver.com (apparently no longer active, but see www.tytex.com); and www.posey.com.

The present invention, providing an innovative contribution to the "useful arts," is designed to ideally provide an innovative, much more effective, comfortable and protective system for protecting, inter alia, the user/patient's hip(s) from damage than achieved in the prior art.

GENERAL DISCUSSION OF INVENTION

Thus, the present invention relates to a hip protector system which solves the shortcomings of the prior art or at least one or more of them, depending on the designed embodiment.

The present invention, directed to a hip protector worm by people, primarily but not exclusively by the elderly, thus is directed to preventing hip fractures, at least in most instances, resulting from a fall from different positions during normal activities.

The currently preferred, exemplary embodiment of the protector preferably is an all-soft or substantially all-soft, protective device using a matching pair of side, hip protective "holsters" or holster-like arrangements interconnected by a waist encircling, preferably all-soft belt band having a pair of protective, all-soft, pad pouches, enclosing protective pads, which are suspended over the user's hips, covering over each greater trochanter of the user, with each holster-like member being secured in place by respective ones of leg, preferably elastic, encircling bands, leaving a substantial amount of open space between them, preferably in both the front and the rear of the device, particularly providing substantial, open, unobstructed areas over the groin and derriere (buttocks) areas of the user.

Each one of the all-soft protective pouches and pads preferably includes a top or upper, primary, shock or force absorbing, foam pad, with an air chamber underneath it, and a closed bottom layer of material with preferably a series of spaced, intermediate, spacer elements or segments supporting the upper pad above the closed bottom layer creating the air chamber, with their being air access into the chamber and also out of the air chamber, when the air chamber is compressed by, for example, an impact force. The bottom layer, which preferably is in direct contact with the user's skin, preferably is made of a "one-way-moisture flow" material which allows moisture to flow up through it (from, for example, the user's skin) but not in the reverse direction, while preferably allowing air to move through it in either direction. Above the bottom layer, on the air chamber side, preferably is a layer of moisture absorbing and holding material, while the air chamber also provides an extended area where moisture also can be held.

The elements made of foam material preferably are enclosed in water-proof/air tight materials.

It is noted that the term "holster" or "holster-like," when used herein means, a worn device which has at least one structure ("holster") or double structures (dual "holsters") hanging down from a waist encircling belt or band over to one side or both sides of the user covering the hip areas, leaving at least the groin and derriere areas of the user open and at least substantially unobstructed, allowing the user to, for example, defecate and/or urinate without removing or significantly touching the hip protector.

When, for example, the user falls on his/her hip while wearing the hip protector device, the upper, primary, protective pad on the impact side primarily absorbs the impact force, while the intermediate spacer element(s), along with even the air chamber in a supplemental manner, also help to absorb the impact force, thereby protecting the user's hip from the impact force.

Each primary, protective pad should be of such a size and cross configuration to physically cover over the user's hip area, particularly for an adult, but preferably not be so large as to cover over or obstruct the user's derriere (buttocks) or groin areas.

Thus, the preferred, exemplary embodiment of the hip protective system of the present invention includes one or more and preferably all of the following characteristics:

(a) The hip protector worm by people, primarily the elderly, preventing or at least substantially diminishing hip fractures, resulting from a fall from different positions during normal activities; and/or (b) The hip protector is an all-soft protective device using a matching pair of hip protector holsters interconnected by a waist encircling belt from which a pair of spaced, protective pad pouches containing force absorbing pads are suspended downwardly over the patient's hips and secured in place below its top by separate, leg encircling bands, one around each leg, leaving a substantial amount of open space between them, preferably in both the front and the rear of the protector, allowing for the user to more easily attend to biological functions in the bathroom or elsewhere; and/or (c) The hip protector can be easily put on, adjusted to fit comfortably and removed by a person who, for example, is elderly, infirm or whose fingers, hands and grip have been weakened by arthritis and/or other neuromuscular conditions, or by a care giver with minimal exertion and/or lifting, with the hip protector preferably avoiding the use of multiple straps, wraps, belt buckles, buttons or zippers; and/or (d) The hip protector is used under clothing (e.g., under pants, dresses, bed clothes or swimming trunks, etc.), is flexible, light weight, and does not interfere with daily living activities or functions, such as sleeping, usual body movements, restroom or bathing activities, etc.; and/or (e) The hip protector has very good hygiene characteristics and aesthetic appearance; and/or (f) The hip protector should be provided in different sizes, but, for a more efficient inventory, the design of the hip proctor preferably is "unisex," useable by either male or female users; and/or (g) The hip protector preferably uses foam pads with interior cavities and air pockets, preferably along with an underlying air or chamber or air distribution head, either sealed or more preferably with an adjacent "breathing" wall, allowing for the controlled dissipation of the compressed air expelled out of the foam cavities and air pockets and the extended air chamber on impact; and/or (h) The hip protector uses extended, preferably peripherally spaced, foam, spacer bands or segments in association with the underside of the primary foam pads with an open area between them with an underside bottom layer preferably made at least in part of a breathable material, allowing an underside, skin breathing area in much of the pad protected area; which breathable bottom layer preferably is made of a flexible, sheet material which allows moisture to flow through it from its outer, exterior side but not in the opposite side, that is, from the side that faces the moisture holding air chamber, etc.

Other basic or important aspects of the invention will become clearer in connection with the detailed description, accompanying drawings, and claims below.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers, and wherein:

FIG. 2 is an isometric view of the exemplary hip protector embodiment of FIG. 1 shown in a partial, rear view; while

Figure 1:
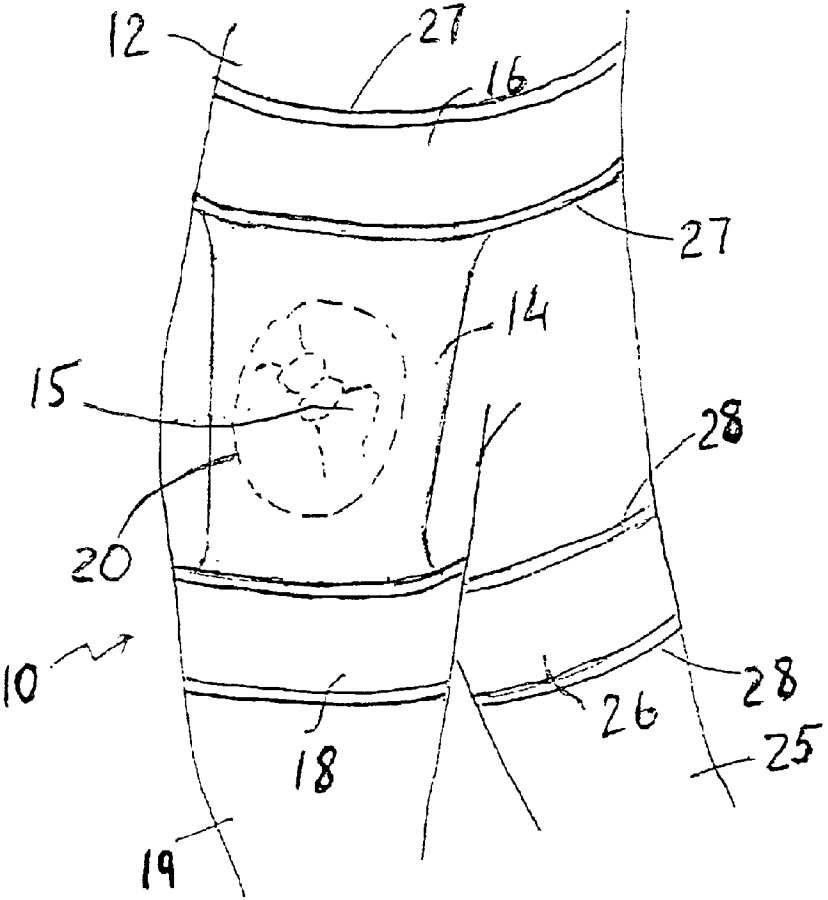
FIG. 1 is an isometric view of a currently preferred, exemplary embodiment of the hip protector system of the present invention worn by a patient shown in a partial front view, with the patient's hip bone structure underlying the protective pad pouch both shown in phantom line.
Figure 3:
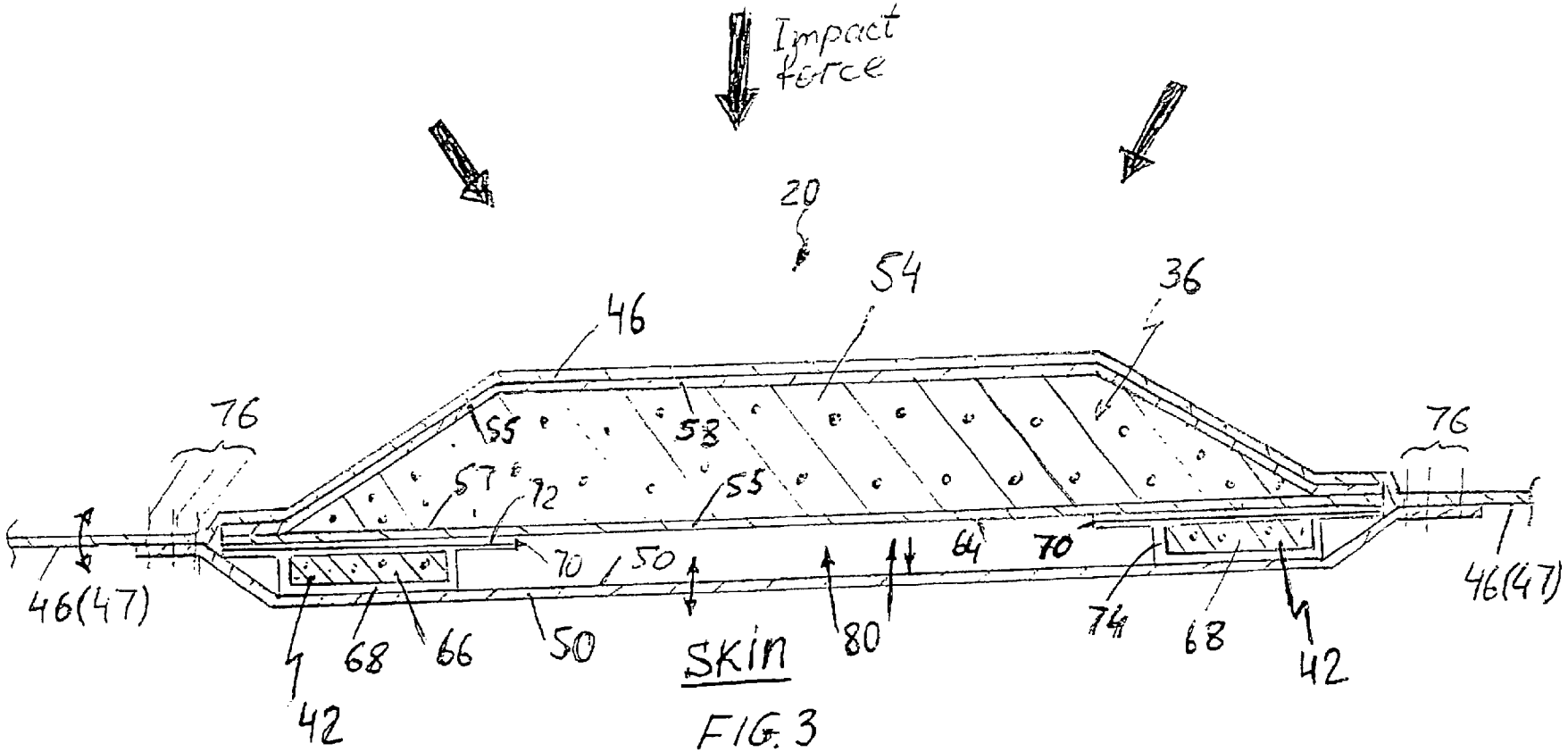
FIG. 3 is a cross sectional view, taken along cross-section line A1–A2 of FIG. 2, including through an opposed pair of intermediate, spacer elements, showing in detail the internal construction of one of the hip protector pouches (attached to its respective holster material), including the upper, primary, foam protective pad, its underlying air chamber, which holds moisture and air, and the bottom layer of flexible sheet material, which is in direct contact with the user's skin when the protective pouch is in use, along with the various other layers of flexible sheet material forming water-tight or resistant pouches enclosing the foregoing elements, with large directional arrows representing impact forces that might arise in a fall, a curved arrow to one side indicating available air flow in both directions, a double tip, straight arrow representing available air flow in both directions, and a larger and smaller, side-by-side pair of arrows representing a "one-directional flow only" material for moisture, which material allows moisture to enter into the air chamber but not leave it.

| Examplary Mode for Carrying Out the Invention Reference Numbers | |
|---|---|
| Primarily FIGS. 1 and/or 2 | |
| hip protector 10 | |
| user or patient 12 | |
| right holster 14 | |
| user/patient's right hip (the right greater trochanter) 15 | |
| waist encircling belt 16 | |
| right leg band 18 | |
| user/patient's right leg 19 | |
| protective pad pouch 20 | |
| left holster 24 | |
| user/patient's left leg 25 | |
| left leg band 26 | |
| stretch laces 27 | |
| stretch laces 28 | |
| Primarly FIGS. 3 and/or 4 | |
| hip protective element 36 | |
| [42 - see below] | |
| outside, top, exterior cover 46 | |
| holster material 47 | |
| inside, bottom cover 50 | |
| body of soft protective foam 54 | |
| waterproof/air-tight pouch 55 | |
| flat base 57 | (also see FIG. 7) |
| flat top 58 | (also see FIG. 7) |
| circumferential rim 60 | |
| upper layer 62 | |
| lower layer 64 | |
| peripherally spaced, intermediate, spacer elements 42 | (also see FIGS. 5 & 6) |
| body of soft foam 66 | (also see FIG. 5) |
| waterproof/air-tight pouch 68 | (also see FIGS. 5 & 6) |
| circumferential rim 70 | (also see FIG. 5) |
| upper layer 72 | (also see FIG. 5) |
| lower layer 74 | (also see FIG. 5) |
| seams 76 | |
| air chamber 80 | |

DISCUSSION OF PREFERRED, EXEMPLARY EMBODIMENT

As can be seen in FIGS. 1–7, the currently preferred, exemplary embodiment 10 of the present invention provides a technique for positioning a pair of all-soft, identical, protective holsters or holster-like members 14, 24 at the hips. In particular, as shown in FIG. 1, the preferably all-soft, hip protector 10 is worn by a user or patient 12 so that the right holster 14 (and in like fashion left holster 24) with its respective protective pad pouch 20 and its enclosed pad 54 are positioned on and extending over and physically covers the patient's right hip (namely, over the right greater trochanter area) 15 and held in place by the action of a, preferably all-soft, elastic, waist encircling belt or belt-like band 16 and an all-soft, flexible, elastic, right leg band 18, which encircles the patient's right leg 19 as shown. Holster 14 is secured to the patient's right leg 19 by the right leg band 18, while the left holster 24 is secured to the patient's left leg 25 by the likewise, preferably all-soft, flexible, elastic, left leg band 26.

Upper and lower fabric edges of the belt 16 preferably have stretch laces 27, while the upper and lower fabric edges of the right leg band 18 and the left leg band 26 have stretch laces 28 to improve the aesthetic look of the hip protector 10, and to help it conform to the patient's body 12 and hold it in place. Belt 16, the right holster 14 with its respective right leg band 18, and the left holster 24 with its respective left leg band 26, can be seen more clearly in FIG. 2.

It should be noted that the right and left holsters 14 & 24, respectively, preferably are restricted to the sides of the user's legs and associated torso and hence are substantially spaced apart from one another, creating large, front and rear open areas between them, particularly providing substantial, open, unobstructed areas over the groin and derriere or buttocks areas of the user. Thus, by design, the construction of the hip protector 10 does not interfere with the user's restroom activities when the user needs to urinate and/or defecate, whether the user is male or female.

As shown in FIG. 3, each protective holster 14/24 includes a circular, primary, protective element 36, four, identical, peripherally & equally spaced (note FIG. 6), intermediate, spacer elements 42, all having an outside most, exterior or outer cover 46 and an exterior, bottom cover 50, which, in use, typically will be in direct contact with the user's skin, while the outer cover 46 will be in contact with the user's clothing, when the hip protector 10 is used under clothing. Each protective element 36 has a body of soft protective foam 54 enclosed in a waterproof/air-tight pouch 55, as can be seen more clearly in FIG. 4.

Figure 4:
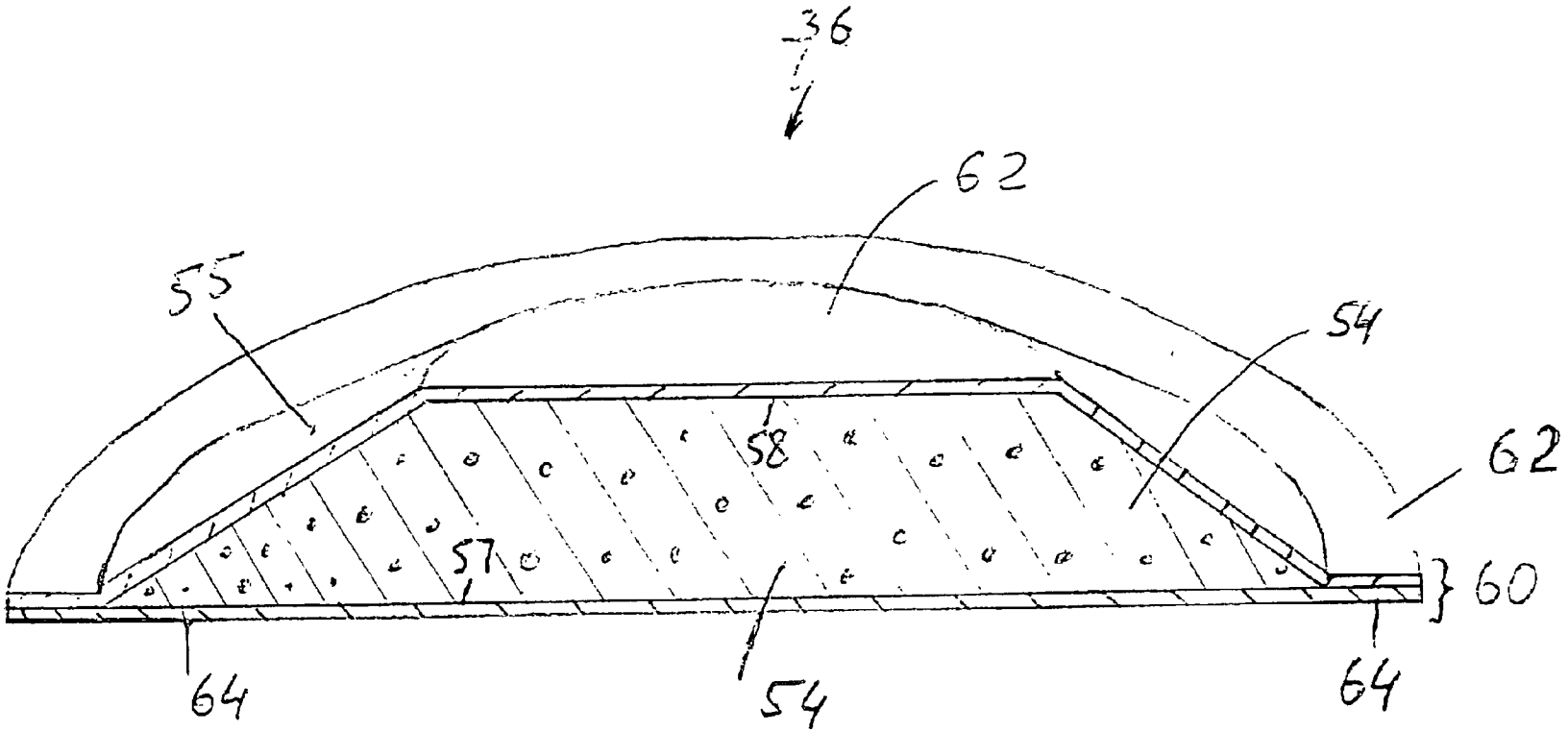
FIG. 4 is an isometric view of the primary, all-soft, protective foam pad, enclosed in its waterproof/air-tight pouch, as also shown in the upper part of FIG. 3.

The body of soft protective foam 54, as can be seen in FIGS. 3 & 4, has a form similar to that of a frustum of a right ellipsular cone with a height "H" (foam body's thickness). This conical section has a flat base 57 and a parallel, top 58, which, with its inclined or angular sides (note line "a" in FIG. 7), form in cross-section a trapezium. The flat base 57, which preferably has the form of an ellipse and has a correlation between a minor axis ("A1") and a major axis ("B1") having, for example, a ratio of about one to one and fifteen hundredths (1 to 1.15). As noted, the perpendicular cross-section of this conical section has the form of an isosceles trapezium.

If the angle between the base and the inclined, side or lateral surface in this conical section is equal to "X" degrees, the flat top 58 of this conical section has the form of an ellipse with minor axis $A2=A1-2H\times ctgX$ and major axis $B2=B1-2H\times ctgX$, where "ctg" is an abbreviation for co-tangent. For example, if H=12.7 mm, A1=180 mm, and X=30 degrees (ctgX=1.732), this will produce:

$B1=180\times1.15=207$ mm; $A2=180-2\times12.7\times1.732=180-44=136$ mm;

$B2=207-2\times12.7\times1.732=207-44=163$ mm.

An ellipse's area $S=\pi\times A/2\times B/2=\pi/4\times A\times B=0.785\times A\times B$, where "A" and "B" are the minor axis and major axes, respectively, of this ellipse, and where "π" is equal to approximately "3.1416." In the exemplary embodiment: $S1=0.785\times180\times207=29249.1$ square mm (about 292 square cm); $S2=0.785\times136\times163=17401.88$ square mm (about 174 square cm). An analysis for different hip protector's sizes indicates that the coverage area of the soft protective foam's base 57 may range from about ninety-six and seven tenths to about three hundred and eighty-seven hundred (96.7 to 387.0 $cm^2$) square cm, which equals about fifteen to about sixty (15 to 60) square inches.

Of course, many variations in the size and configuration of the protective pad pouch 20 and its primary foam body 54 are possible. With respect to the size, it needs to be sufficiently large to properly cover over the hip area to be protected in both dimensions, but not be overly large, and, in particular, preferably not extend over and block either the groin or buttocks areas of the user, allowing the user to defecate or urinate without having to remove the hip protector. Likewise, although an elliptical shape is preferred, other configurations are also possible.

The soft protective foam body 54 preferably is made of a high density, open-cell urethane foam. Another name of this material is "memory foam"—when, for example, one presses on this foam by applying ones palm under some force and then removes the palm, one will see the imprint of the palm and then, as time goes by, the "memory foam" slowly will return to its original shape. Thus; after the removal of a prolonged loading, for example, after the long time resting of an elderly person on a bed or the like, this foam material returns to its original shape.

For the exemplary hip protector 10 this protective foam body 54 has, for example, a thickness of about twelve and seven-tenths (12.7) mm and a density between about one hundred and thirty to about two hundred (130–200) kg/cubic meter, as, for example, is manufactured by EAR Specialty Composites (Indianapolis, Ind.) and sold under the trademark "Confor"™. As shown by some bio-mechanical tests (see, for example www.hipsaver.com), open-cell urethane foam, with the same thickness and density noted above, enclosed in a waterproof/air-tight pouch 55, lowers a typical falling force of 7,200 N to the force 1,790 N (below the typical fracture threshold of 2,110 N of the hip) and the displaced air from the foam inflates the surrounding, sealed pouch 55 formed by flexible sheet material (the force is thereby redistributed over a larger and softer area).

The pouch 55 can be made, for example, preferably from a solid and waterproof/air-tight material such as, for example, "nylon" of, for example, about three-tenths to about four-tenths (0.3–0.4) mm thickness. The pouch 55 can have, for example, a curved, circumferential rim 60 of about five to eight (5–8) mm in width, which can be made, for example, by jointly heating all of the circumferential parts of the overlapping, upper layer 62 and lower layer 64 of the pouch's material, joining them together (see FIG. 4).

The intermediate elements 42 each preferably has a body of soft foam 66, which likewise preferably is enclosed in a waterproof/air-tight pouch 68. The intermediate elements 42 can be seen more clearly in FIG. 5. The soft foam body 66 can be made of the same material as the soft protective foam body 54, and has the form of, for example, a rectangular parallelepiped, and can have, for example, the following sizes—a length of about forty to about eighty (40–80) mm, a width of about ten to about twenty-five (10–25) mm, and a thickness (height) of about three to about four (3–4) mm.

Figure 5:
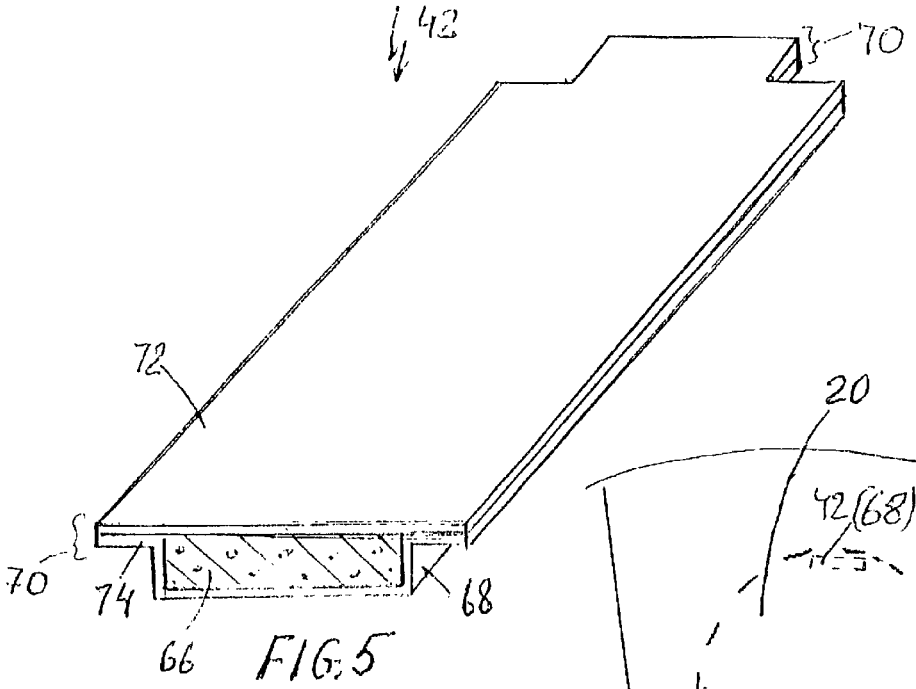
FIG. 5 is an isometric, cross-section view of one of the intermediate, spacer elements, two of which are shown in cross-section in the lower part of FIG. 3, and all four of which are shown in FIG. 2.

With reference also to FIG. 5, the waterproof/air-tight pouch 68 includes an overlapping, upper layer 72 and a lower layer 74, both made of, for example, the same material as pouch 55, and can have the same type of peripheral rim 70, similar to the rim 60, but being made of straight line sections compared to a circular form. The upper layer 72 of each of the pouches 68 can be fastened to the lower layer 64 of pouch 55 by glue or other adhesive or other suitable fastening.

The protective element 36 with its spaced, intermediate, spacer elements 42 are enclosed in the protective pad pouch 20 which preferably is made from flexible sheet fabric. As shown in FIG. 3, the outside, exterior, top cover 46 and the inside cover or bottom layer 50 of the pouch 20 are united by, for example, stitching.

The protective element 36 thus is secured at its periphery by, for example, three seams 76 of this stitching. The distance between two, adjacent seams 76 can be, for example, about three to about four (3–4) mm. In the illustrated exemplary embodiment 10, the material of the top, exterior cover 46 is continuous, extending past the pouch 20 area and forms the same material for the holster material 47 (see FIG. 3).

Due to the presence of the intermediate, spacer elements 42, there is an extended air chamber 80 formed between the inside cover or bottom layer 50 of the pouch 20 and the lower layer 64 of the pouch 55. This air pocket 80 serves both to be a repository for moisture from the user's sweating and also as a supplemental, cushioning buffer to the user's hip should the user fall on the user's hip area(s).

The belt 16, leg bands 18/26, holster material 47, outside cover 46 and inside cover 50 are made from flexible, sheet fabric (detailed more fully below), which can "breathe." Because of this, the user's skin under the belt 16, the holsters 14/24, the leg bands 18/20 can "breathe" too. "Breathing" air chamber 80 allows the user's skin to breath under and through the inside cover 50, while also serving as an extra protective cushioning buffer for the protected hip area, supplementing the cushioning effects of the soft foam body 54 (the primary cushioning material) and the soft foam bodies 42 (the secondary cushioning material).

As generally indicated by the curved directional arrow in FIG. 3, air preferably is able to flow through the material 46/47 and into and out of the sheet material of the bottom, inner cover layer 50 (note double-headed, straight directional arrow), as well as between the spaces between adjacent spacer elements 42. This allows the air in the air chamber 80 to escape during, for example, any compressive impact force being applied or the user's sleeping on the hip side, while also allowing air to return(breathe in) to the air chamber after any compressive forces no longer exist.

Figure 2:
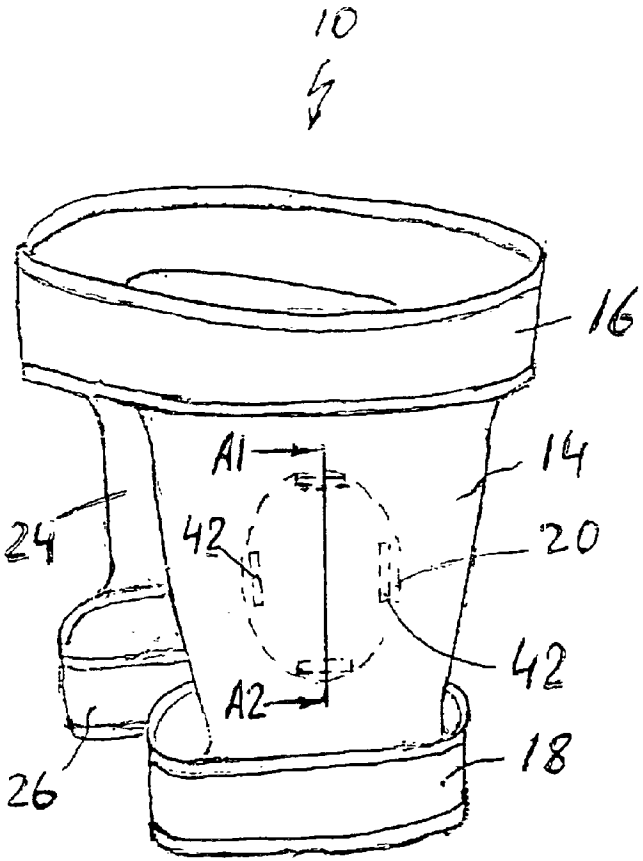
Figure 6:
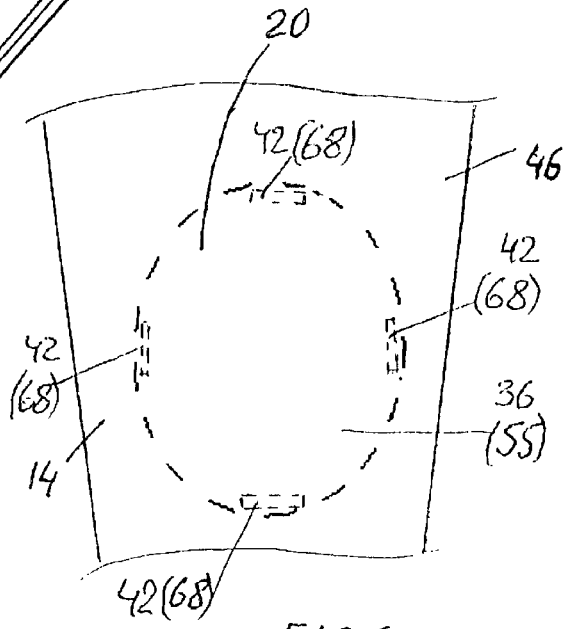
FIG. 6 is a partial, side view of one of the holsters shown in FIGS. 1 & 2, showing in phantom line the exemplary four, extended, spaced, intermediate, spacer elements, peripherally spaced relatively to its respective, primary protective foam pad and each orthogonally directed with respect to its respective radius to the center point of the pad's elliptical shape.

One example of the many possible locations of all of the longitudinally extended, spaced, intermediate elements 42 (with pouches 68) relative to the protective element 36 (with pouch 55), which is currently preferred, is that shown in FIGS. 2 & 6, namely, four, orthogonally directed & peripherally disposed, spacer elements, spaced symmetrically and substantially equally apart from one another at their centers by ninety (90°) degrees about the center point or vertical, center-line axis of the protective element 36. Other exemplary variations include the use of, for further example, three spaced, spacer elements or five or six, etc., or even only two. Even only one, continuous member (not nearly as preferred due to it limiting "breathing") could be used, which, of course, could be considered equivalent to an infinite number of juxtaposed, spacer elements. Although having the spacer elements 42 positioned along the outer periphery of the foam body 54 is preferred, a further, possible alternative is to position some along the outer periphery and one or more in the interior or central area(s) of the air chamber 80. Additionally, as an alternative to the rectangular shape, another exemplary shape would be a cylindrical shape [with, for example, a height of about two to about three (2–3) mm and a diameter of about thirty to about forty (30–40) mm], or an oval shape or other shape which provides a supporting, spacer role between the fabric layers 50 & 64 to form an adequate, interior air chamber (80).

The material for the belt 16, the leg bands 18/26, the outside cover 46, the holster material 47 and the inside cover 50 (all these details, except the outside cover 46, contact with the user's skin, and form inner cover) should be flexible sheet fabric material having the qualities and properties listed in the following table:

| Qualities of Fabric | Properties When Used with the Exemplary Embodiment |
|---|---|
| 1. Softness, lightness | 1. Comfort for hip protector's user. |
| 2. Fits snugly by stretching to the body's shape. | 2. Easy to put on the hip protector with proper positioning of both protective holsters; fits any user figure well, closely following the user's contours. |
| 3. Transports sweat away from the user's skin to the other side of the fabric. | 3. The user's skin under the hip protector typically will be dry during usual and sport activities. |
| 4. Able to "breathe," anti-bacterial | 4. Good hygienic characteristics, for example, allows user's skin under the hip protector to "breathe." |
| 5. Can be stretched at least a few times with following return to the point of departure. | 5. User can soap and wash skin under hip protector. Hip protector's user does not interfere with daily and sleeping activities. |
| 6. Easy to wash and very quick to dry. | 6. Easy care. |

For this fabric material can be used, for example, "Tactel Aquator"® or from "CoolMax"® with "Lycra."® fabrics, manufactured by DuPont Fibers (New York, N.Y.), have all of these qualities.

When a cross sectional view of the protective foam body 54 has the form of a trapezium as shown in FIGS. 3 & 4, the same will be the configuration of the outside cover 46. In this case one will see two, concentric ellipses at the outward surface of the outside cover 46 (in FIGS. 1, 2 & 6 these two ellipse are not shown for simplicity purposes but note FIG. 4). These two ellipses correspond to the concentric outlines of the flat top 58 and the flat base 57 of the protective foam body 54 along their side or lateral lines. This situation is shown by the straight line "a" extending from an at points "A–B" in FIG. 7.

Figure 7:
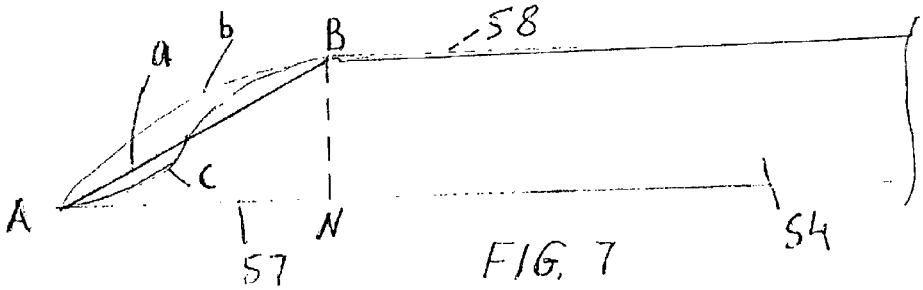
FIG. 7 is a side, generalized view showing three, different variations (lines "a"/"b"/"c") of he lateral or side surface profiles of the soft protective foam body of the primary protective pad of FIG. 4.

One would see only one ellipse (corresponding to the flat base 57 only), when the lateral or side surface of the foam body 54 has a simple, fluent or curved passage with respect to the surface of the flat top 58, as exemplified by the singularly curved, convex, line "b" in FIG. 7 for the side configuration of the primary foam body 54.

A more aesthetically pleasing appearance for the hip protector occurs when the side or lateral surface of the foam body 54 has two fluent or curved passages between the surface of the flat top 58 and the surface of the flat base 57, producing the doubly or compoundly curved line "c" of FIG. 7, that is, concave at the bottom area and convex at the upper area, for the side configuration of the primary foam body 54. This version currently would be most preferred for at least aesthetics reasons.

The exemplary hip protector 10 preferably is provided in different sizes, with the different sizes being based on measuring around the widest part of the hip. The hip size ideally will show the hip protector size. The size of the holsters and protective pads will be of suitable size for the size of the hip protector. The exemplary embodiment of the hip protector 10 can be more efficiently inventoried because it does not interfere for what user this hip protector was made—construction of this hip protector preferably is identical for both male and female users, with there being no need to distinguish between the two.

It is noted that the embodiment(s) described herein in detail for exemplary purposes are of course subject to many different variations in structure, size, design, application and methodology. Because many varying and different, additional embodiments may be made within the scope of the inventive concepts herein taught, and because many modifications may be made in the embodiments herein detailed in accordance with the descriptive requirements of the law, it is to be understood that the details herein are to be interpreted as illustrative and not in a limiting sense.

What is claimed is:

1. A hip protector for wearing use by a user having hips for at least reducing, if not preventing, hip fractures, which might otherwise result from a fall, comprising:

a substantially all-soft, hip protector having a pair of substantially spaced apart, hip protector, holster members interconnected by a waist encircling, belt band, each of said holster members carrying a protective pad pouch made of flexible sheet material for placement over respective ones of the user's hips and to be secured in place by separate, leg encircling bands, one for each of the user's legs and for each of said holster members and its respective one of said protective pouches, leaving substantial, open, unobstructed areas over the groin and derriere areas of the user, when said holster members and their respective protective pad pouchs are positioned over the hip areas of the user;

each of said hip protective pad pouches further including:

(a) an all-soft, primary, impact force absorbing, protective element having a soft foam body enclosed in its respective one of said holster member's respective protective pouch;

(b) a series of at least two, spaced, intermediate, spacer elements of all-soft material, each of which has a soft foam body, with each enclosed in a separate pouch made of flexible sheet material, and are located underlying said primary foam body; and (c) an outside cover and an inside cover of flexible, sheet material combined together enclosing said protective element and said series of intermediate, spacer elements, forming an enclosed air chamber underlying said protective element, said primary, impact force absorbing, protective element, said spacer elements and said air chamber, combined together to absorb the impact force when the user falls on either one of the user's hips.

2. The hip protector system of claim 1, wherein:

each of said protective element's soft foam bodies is made of an open-cell, urethane foam with a density of about 130–200 kg/cubic meter, and a thickness of about twelve and seven-tenths (12.7) mm and having the shape of a frustum of a right ellipsular, conical section.

3. The hip protector system of claim 1, wherein:

each of said intermediate, spacer element's soft foam body is made from an open-cell urethane foam with a density of about 130–200 kg/cubic meter.

4. The hip protector system of claim 1, wherein:

each of said protective element's soft foam bodies has a thickness of about twelve and seven-tenths (12.7) mm and the shape of a frustum of a right ellipsular, conical section.

5. The hip protector system of claim 1, wherein:

each of said intermediate, spacer element's soft foam body has a rectangular shape with a length of about 40–80 mm, a width of about 10–25 mm, and a thickness of about 2–3 mm.

6. The hip protector system of claim 1, wherein there is further included:

a pouch of flexible sheet material for each of said protective elements, enclosing said protective element; and a separate, spacer pouch of flexible sheet material for each of said intermediate, spacer elements, enclosing said intermediate, spacer element;

all of said pouches being made from a waterproof/air-tight material.

7. The hip protector system of claim 6, wherein:

said waterproof/air-tight material is about 0.3–0.4 mm thick.

8. The hip protector system of claim 1, wherein:

said belt band, said leg bands, said inside cover, and the material of said holsters members contact with the user's skin, and form inner cover, and are all made from a fabric which transports moisture away from the user's skin to the other side of the fabric but prevents the moisture from going in the opposite direction, said fabric also being resiliently stretchable.

9. The hip protector system of claim 1, wherein:

said flexible sheet material used for the pouch for said protective element and said flexible sheet material for each of the pouches for said spacer elements are all made of at least water-resistant material, if not water-tight material, all creating water-resistant, if not water tight pouches.

10. The hip protector system of claim 8, wherein the user has skin, and wherein:

an inner cover including the belt band, leg bands and inside cover lies against and is in direct contact with the user's skin when the hip protector is being worn by the user and is made of a material which allows only "one-way-moisture flow," allowing sweat from the user's skin to pass through it into said air chamber but preventing it from returning.

11. The hip protector system of claim 10, wherein:

said flexible sheet material for said inner cover is made of a material having the following qualities:

| Qualities of Fabric |
|---|
| 1. Softness, lightness |
| 2. Fits snugly by stretching to the body's shape. |
| 3. Transports sweat away from the user's skin to the other side of the fabric. |
| 4. Able to "breathe," anti-bacterial |
| 5. Can be stretched at least a few times with following return to the point of departure. |
| 6. Easy to wash and very quick to dry. |

12. An impact-force-absorbing, protective pad for use as at least part of a hip protector for wearing use by a user over one of the user's hips for protecting the user from hip fractures, which might otherwise result from a fall on that hip, comprising:

(a) an all-soft, primary, impact force absorbing, protective element having a soft foam body enclosed in a protective pouch made of flexible sheet material and being of such a size and cross configuration to physically cover over an adult user's hip area;

(b) a series of at least two, spaced, intermediate, spacer elements of all-soft material, each of which has a soft foam body, with each enclosed in a separate pouch of flexible sheet material, said spaced, intermediate, spacer elements being located underneath said primary foam body; and (c) an outside cover and an inside cover of flexible, sheet material combined together enclosing said protective element and said series of intermediate, spacer elements, forming an enclosed air chamber underlying said primary, impact force absorbing, protective element, said primary, impact-force-absorbing, protective element, said spacer elements and said air chamber, combined together to absorb impact force on the outside cover when the user falls on that hip.

13. The impact-force-absorbing, protective pad of claim 12, wherein the user has skin, and wherein:

an inner cover including said inside cover lies against and is in direct contact with the user's skin when said protective pad is being worn by the user over the user's hip and is made of a material which allows only "one-way-moisture flow," allowing sweat from the user's skin to pass through it into said air chamber but preventing it from returning.

14. The impact-force-absorbing, protective pad of claim 12, wherein:

said flexible sheet material used for the pouch for said protective element and said flexible sheet material for each of the pouches for said spacer elements are all made of at least water-resistant material, if not water-tight material, all creating water-resistant, if not water tight pouches.

15. The impact-force-absorbing, protective pad of claim 12, wherein:

there are two of said protective pads, one for each of the user's hips; and wherein there is further included a pair of substantially spaced apart, hip protector, holster members interconnected by a waist encircling, belt band, said holster like members each carrying one of said protective pad pouches for placement over respective ones of the user's hips and to be secured in place by separate, leg encircling bands, one for each of the user's legs and for each of said holster members and its respective one of said protective pads, leaving substantial, open, unobstructed areas over the groin and derriere areas of the user, when said holster members and their respective protective pads are positioned over the hip areas of the user.

16. A method of protecting the hip of a user having two hips and two legs from impact forces occurring due to a fall using a pair of two, substantially separated, holster members interconnected together by a waist encircling belt band and two, separate leg bands separately connecting each one of said holster member to separate ones of the user's legs, comprising the following steps:

(1) using on each one of said holster members an impact-force-absorbing, protective pad (i) an all-soft, primary, impact force absorbing, protective element having a soft foam body enclosed in a protective pouch made of flexible sheet material;

(ii) a series of at least two, spaced, intermediate, spacer elements of all-soft material, each of which has a soft foam body, with each enclosed in a separate pouch of flexible sheet material, said spaced, intermediate, spacer elements being located underneath said primary foam body; and (iii) an outside cover and an inside cover of flexible, sheet material combined together enclosing said protective element and said series of intermediate, spacer elements, forming an enclosed air chamber underlying said primary, impact force absorbing, protective element; and (2) positioning said protective pads over respective ones of the user' hips; and (3) using at least one of said protective elements, its respective spacer elements and its respective air chamber, combined together, to absorb an impact force on the outside cover when the user falls on that respective hip.

17. The hip protecting method of claim 16, wherein there is included the steps of:

placing an inner cover including the belt band, leg bands and inside cover of each of said protective elements against and in direct contact with the user's skin when said protective pad is being worn by the user over the user's hip; and using a material which allows only "one-way-moisture flow," allowing sweat from the user's skin to pass through it into said air chamber but preventing it from returning.

* * * * *